US012747730B2

(12) United States Patent
Itou et al.

(10) Patent No.: US 12,747,730 B2
(45) Date of Patent: Sep. 29, 2026

(54) AIR COMPRESSOR

(71) Applicant: Hitachi Industrial Equipment Systems Co., Ltd., Tokyo (JP)

(72) Inventors: Yuuji Itou, Tokyo (JP); Naohiro Ota, Tokyo (JP); Takehiro Matsuzaka, Tokyo (JP)

(73) Assignee: HITACHI INDUSTRIAL EQUIPMENT SYSTEMS CO., LTD., Tokyo (JP)

( * ) Notice: Subject to any disclaimer, the term of this patent is extended or adjusted under 35 U.S.C. 154(b) by 0 days.

(21) Appl. No.: 18/876,088

(22) PCT Filed: Jun. 26, 2023

(86) PCT No.: PCT/JP2023/023634
§ 371 (c)(1),
(2) Date: Dec. 17, 2024

(87) PCT Pub. No.: WO2024/018848
PCT Pub. Date: Jan. 25, 2024

(65) Prior Publication Data

US 2025/0382963 A1 Dec. 18, 2025

(30) Foreign Application Priority Data

Jul. 20, 2022 (JP) ..... 2022-115958

(51) Int. Cl.
*F04C 28/28* (2006.01)
*F04B 25/00* (2006.01)
(Continued)

(52) U.S. Cl.
CPC ..... *F04C 28/28* (2013.01); *F04B 25/00* (2013.01); *F04B 39/02* (2013.01); *F04B 39/066* (2013.01);
(Continued)

(58) Field of Classification Search
CPC ..... F04C 28/28; F04C 18/12; F04C 29/02; F04C 29/04; F04C 2270/19; F04B 25/00;
(Continued)

(56) References Cited

U.S. PATENT DOCUMENTS 6,551,082 B2 * 4/2003 Douzono ..... F04C 29/04 418/9
8,313,312 B2 * 11/2012 Fujimoto ..... F04C 23/001 418/201.1
(Continued)

FOREIGN PATENT DOCUMENTS

JP 05-264135 A 10/1993
JP 06-201236 A 7/1994
JP 2021-14790 A 2/2021

OTHER PUBLICATIONS

International Search Report of PCT/JP2023/023634 Aug. 29, 2023.

*Primary Examiner* — Charles G Freay
(74) *Attorney, Agent, or Firm* — MATTINGLY & MALUR, PC

(57) ABSTRACT

To provide a packaged air-cooled air compressor capable of recommending cooler cleaning at the proper timing while controlling cost increase. The package-type, air-cooled air compressor has two cooling paths to the air-cooled cooler and motor, two cooling air intake ports where these cooling paths take in outside air, a fan and outlet that collectively exhaust cooling air after cooling the cooler and motor to the outside, and a bearing located at both ends of the motor shaft. The controller calculates the temperature difference between the bearings located upstream (anti-load side) and downstream (load side) of the motor shaft in the cooling air flow direction, and determines that the cooler is clogged if the temperature difference is less than a threshold value.

7 Claims, 4 Drawing Sheets

(51) Int. Cl.

| | |
|---|---|
| ***F04B 39/02*** | (2006.01) |
| ***F04B 39/06*** | (2006.01) |
| ***F04B 49/10*** | (2006.01) |
| ***F04B 51/00*** | (2006.01) |
| ***F04C 18/16*** | (2006.01) |
| ***F04C 29/02*** | (2006.01) |
| ***F04C 29/04*** | (2006.01) |

(52) U.S. Cl.
CPC ..... *F04B 49/10* (2013.01); *F04B 51/00* (2013.01); *F04C 18/16* (2013.01); *F04C 29/02* (2013.01); *F04C 29/04* (2013.01); *F04B 2207/70* (2013.01); *F04C 2270/19* (2013.01)

(58) Field of Classification Search
CPC ..... F04B 39/02; F04B 39/066; F04B 49/10; F04B 51/00; F04B 2207/70
See application file for complete search history.

(56) References Cited

U.S. PATENT DOCUMENTS

| | | | | |
|---|---|---|---|---|
| 9,394,906 | B2 * | 7/2016 | Fujimoto | F04C 29/02 |
| 10,690,135 | B2 * | 6/2020 | Lee | F04C 18/18 |

* cited by examiner

AIR COMPRESSOR

TECHNICAL FIELD

This invention relates to packaged air-cooled air compressor.

BACKGROUND ART

In packaged air-cooled air compressor, it is necessary to prevent compressed air suction of a filter (suction filter) and an air-cooled heat exchanger (cooler) for cooling compressed air and lubricating oil from losing capacity due to clogging from dust and other particles in the outside air. For this reason, a cleaning work for each predetermined operating time or period is reported in the operation manual or on a touch panel.

The progression of clogging of filters and coolers varies depending on the operating environment and other factors, and periodic cleaning will cause inconvenience. For example, if the cleaning timing is too late, the compressor may stop operation due to a rise in compressed air temperature, or the compressor itself may function poorly, resulting in increased power consumption and reduced component life. If the dirt is severe, the number of man-hours required for cleaning may increase. On the other hand, if the cleaning timing is too early, it may result in excess work, leading to lower operating efficiency of the air compressor and higher costs.

Patent Document 1 (JP 2021-14790A) discloses a method of estimating the progress of clogging and determining clogging by setting a threshold value to the detected temperature and pressure in an outdoor air filter installed for compressed air intake by using an existing sensor that detects compressed air pressure (exhaust pressure) and temperature (exhaust temperature) in the compressor and setting threshold values for the detected temperature and pressure.

CITATION LIST

Patent Literature

PTL: JP 2021-14790A

SUMMARY OF THE INVENTION

Technical Problem

When a cooler is clogged, compressed air cooling is insufficient, and according to the technology of Patent Document 1, it is possible to estimate the cooler clogging by the exhaust temperature detected by a sensor. However, if the exhaust temperature changes due to other factors such as clogging of the suction filter, or if multiple coolers are used, such as for oil, the estimation accuracy of cooler clogging may be low. In addition, although it is possible to estimate cooler clogging by adding a sensor that detects the flow rate of cooling air flowing in the cooler section or the differential pressure in the cooling air path, the cost increases due to the addition of sensors, control changes for flow rate and pressure detection, and additional equipment.

Solution to Problem

Solutions to the above issues are shown below.

A packaged air-cooled air compressor has a compressor body, a motor that drives the compressor body, an air cooler that cools the air compressed by the compressor body, the motor and the compressor body, and an enclosure that houses the compressor body, motor and cooler.

The air compressor separates the cooler cooling path, in which external air is sucked in through a cooler intake port in the chassis to cool the cooler, and the motor cooling path, in which external air is sucked in through a motor intake port in the chassis to cool the motor, and has an opening that merges the cooler cooling path and the motor cooling path. The cooler duct and an exhaust port provided in the enclosure to exhaust air from the cooler cooling path and the motor cooling path, which are merged by the aperture, to the outside of the enclosure.

The air compressor further comprises a first sensor that detects the temperature of the bearing on the load side of the motor and a second sensor that detects the temperature of the bearing on the anti-load side of the motor, a controller that calculates the temperature difference between the first sensor and the second sensor, and determines that the cooler is clogged if the temperature difference is less than a threshold value, and a display unit that reports a cleaning recommendation when the cooler is determined to be clogged by the controller.

These methods make use of the fact that when the cooler is clogged, the amount of cooling air passing through the cooler cooling path decreases and the amount of cooling air passing through the motor cooling path increases, resulting in a smaller temperature difference between the two bearings provided at both motor shaft ends, which enables the use of existing sensors to estimate the cooler clogging. This allows the air compressor to estimate the cooler clogging using existing sensors and to report the recommendation of cooler cleaning at an appropriate timing while controlling the cost increase.

Advantageous Effects of Invention

According to the present invention, by using an existing sensor installed in the air compressor to estimate cooler clogging, it is possible to recommend cooler cleaning at the proper timing while keeping cost down. Issues, configurations, and effects other than the above are shown by the description of the following embodiments.

DESCRIPTION OF EMBODIMENTS

Specific examples of the invention are described below based on the drawings.

Figure 1:
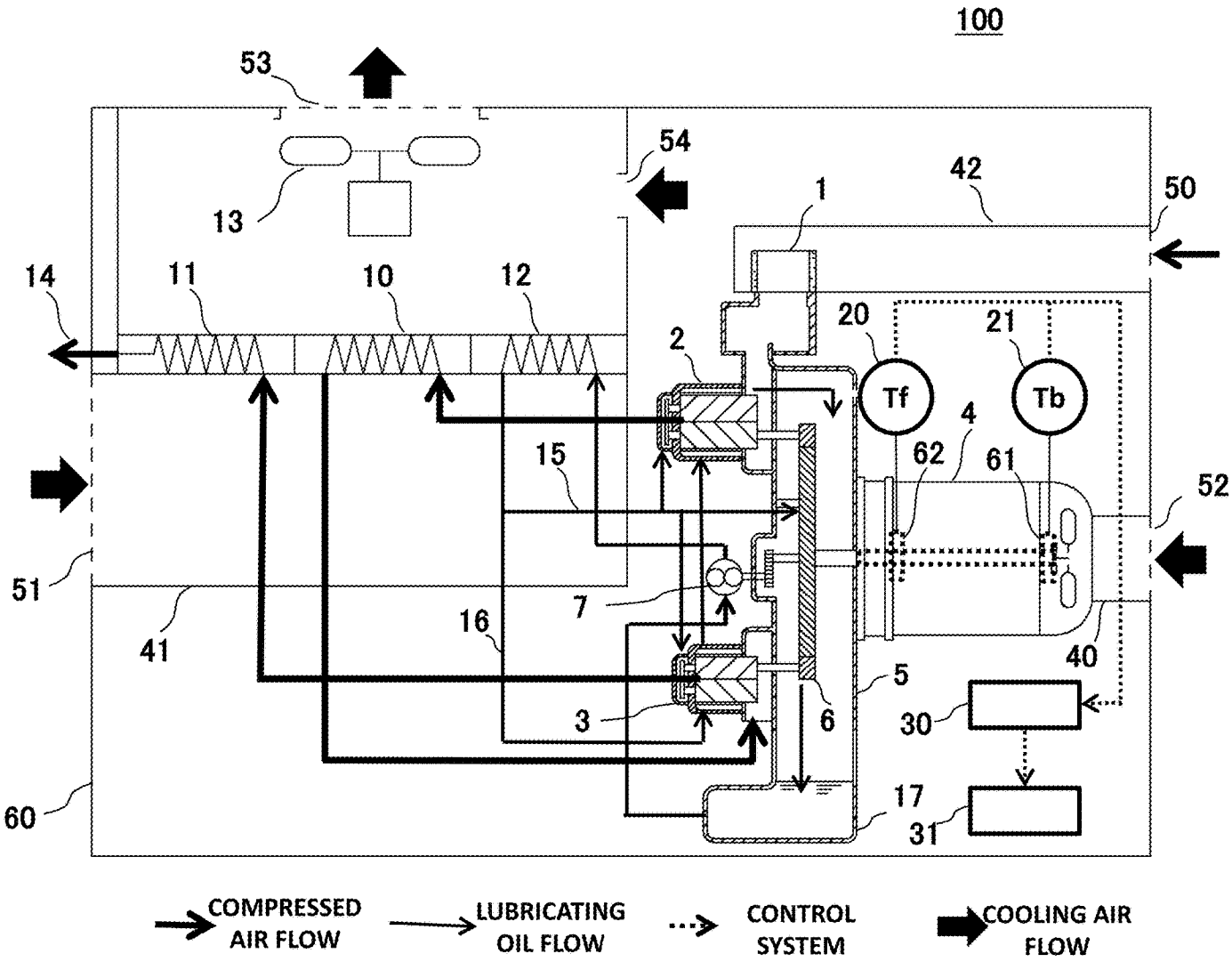
FIG. 1 shows a schematic diagram of an air-cooled oil-free screw compressor.

FIG. 1 shows a schematic diagram of an air-cooled oil-free screw compressor. The air compressor 100 comprises a low-pressure stage compressor body 2 and a high-pressure stage compressor body 3 as multi-stage compressor bodies. Each compressor body has a pair of male and female screw rotors that mesh with each other, and an incremental gear 6 that rotates and drives the low-pressure stage compressor body 2 and high-pressure stage compressor body 3.

The air compressor 100 is equipped with a casing 5. The air compressor 100 is not limited to a two-stage compressor body.

The air compressor 100 also includes motors 4 (electric motors) to drive each compressor body, an compressed air intake 50 to intake external air used for compression, air intake (cooler intake) for coolers 51 to intake external air used for cooling coolers, an air intake 52 for the a motor (motor intake) that draws in external air used to cool the motor, a cooler 10 for low-pressure stage exhaust air, a cooler 11 for exhaust air for the high pressure stage, a cooler 12 for oil, a controller 30 that controls the motor 4, a display unit 31, and an enclosure 60 that houses them. The cooler 10 for low-pressure stage exhaust air, the cooler 11 for high-pressure stage exhaust air, and the cooler 12 for oil are collectively referred to simply as the cooler.

The compressor body of the air compressor 100 has multiple compression chambers formed in the tooth grooves of the screw rotor. The low-pressure stage compressor body 2 and the high-pressure stage compressor body 3 are each driven rotationally by the motor 4, which serves as the drive source, through the increasing gear 6. The controller 30 is composed of, for example, a CPU and a memory, and a controller controls the motor 4 and the display unit 31. Controller 30 can also be configured with an FPGA or ASIC instead of a CPU.

External air used for compression is taken from compressed air intake 50 in enclosure 60 and supplied to the low-pressure stage side compressor body 2 through the compressed air intake duct 42 and intake filter 1 to be compressed to a predetermined pressure. The compressed, hot air is cooled by the low-pressure stage exhaust air cooler 10 and then fed to the high-pressure stage side compressor body 3. The high-pressure stage compressor body 3 compresses the air to a predetermined pressure, and the hot air is cooled by the high-pressure stage exhaust air cooler 11, and then exhausted to the outside 14 of the compressor 100. The cooler 10 for low-pressure stage exhaust air and the cooler 11 for high-pressure stage exhaust air are called air coolers. The path of air that takes in external air used for compression and exhausts it to the outside through the low-pressure stage exhaust air cooler 10 from the low-pressure stage side compressor body 2 and through the high-pressure stage exhaust air cooler 11 from the high-pressure stage pressure side compressor body 3 is called a compression system.

The oil used for lubrication and cooling is replenished in a pool 17 of gear casing 5, and after being cooled by cooler for oil 12 via pumps for oil 7, it is branched into lubrication path 15 and cooling path 16 to supply each piece of equipment. The pool serves to hold oil in place.

In lubrication path 15, oil is supplied to incremental gear 6, bearings in low-pressure stage compressor body 2 and high-pressure stage compressor body 3, and then collected in the pool 17 in gear casing 5. In the cooling path 16, oil is supplied to the jacket of the casing of each compressor body in the order of high-pressure stage compressor body 3 and low-pressure stage compressor body 2, and then collected in the pool 17 in gear casing 5.

The cooling air of the cooler 10 for low-pressure stage exhaust air, cooler 11 for high-pressure stage exhaust air, and cooler 12 for oil is taken into air compressor 100 from air intake 51 for cooler located in enclosure 60. The cooling air for the motor is drawn into the air compressor 100 from the air intake 51 for cooler in enclosure 60.

In the cooler cooling path, cooling fan 13 draws in external air from cooler intake 51, which is fed through cooler duct 41 to cooler 10 for low-pressure stage exhaust air, cooler 11 for high-pressure stage exhaust air, and cooler 12 for oil, for cooling respective coolers.

In the motor cooling path, external air for cooling the motor is drawn in from the motor intake 52 by the self-cooling fan 61 on the cooling air intake side of the motor 4. After passing through the motor cooling air intake duct (motor duct 40), the external air is supplied to the anti-load side bearing 61, housing, and load side bearing 62, which are installed in motor 4, in that order, and the bearings are each cooled through the bracket section that houses them. The air after cooling the motor is drawn into the cooler duct 41 from the opening 54 at the above cooler duct 41, together with air that has been heated by the compressor bodies 2 and 3, their piping, electrical parts, and other heating elements other than the cooler section installed inside the air compressor 100. The cooled air is then exhausted out of the air compressor 100 together with the cooler cooled air from the cooling air exhaust port 53 on the exhaust side of the cooling fan 13.

The cooler cooling path and the motor cooling path draw cooling air from the outside by means of different intake ports (cooler intake 51 for cooler cooling air and motor intake 52 for motor cooling air) on the enclosure 60 of the air compressor 100, respectively. The cooler cooling path and the motor cooling path are configured by a common fan 13 to be exhausted to the outside through one cooling air exhaust port 53 of the air compressor 100. Cooler duct 41 supplies external air to cooler 10 for low-pressure stage exhaust air, cooler 11 for high-pressure stage exhaust air, and cooler 12 for oil via cooler intake 51, and functions to separate the motor cooling path in the enclosure 60 of the air compressor 100.

The motor 4 in the air compressor 100 is equipped with a temperature sensor 20 for the motor load side bearing in the bracket that houses the load side bearing 62 to protect against ignition or damage due to temperature rise. And the motor 4 in the air compressor 100 is equipped with a temperature sensor 21 for the motor anti-load side bearing in the bracket that houses the anti-load side bearing 61. The controller 30 records the temperature detected by each sensor and stops the compressor if the preset temperature is exceeded and displays the cause of the compressor stoppage, such as "motor temperature abnormal" on the display unit 31.

Figure 2:
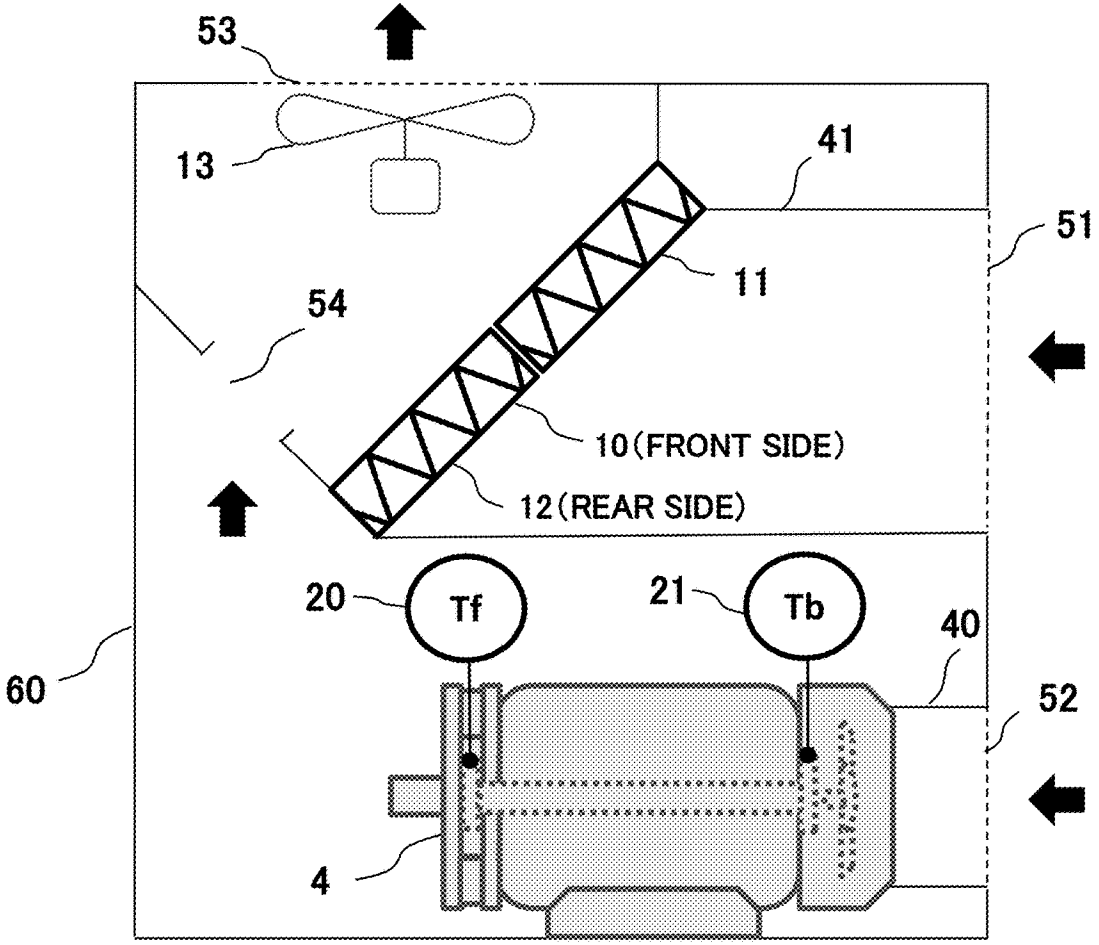
FIG. 2 shows a cooling system structure and cooling air path.

FIG. 2 shows a schematic of the arrangement of the equipment and the flow of cooling air related to the cooling of the low-pressure stage exhaust air cooler 10, the high-pressure stage exhaust air cooler 11, the oil cooler 12 (various coolers) and the motor 4 in this cooler cooling route and motor cooling route. The cooler 11 for exhaust air for the high-pressure stage is installed in the entire depth direction of the paper, the cooler 10 for exhaust air for the low-pressure stage is installed in the front part of the paper below cooler 11, and the cooler 12 for oil is installed in the rear part of the paper below cooler 11.

As shown in FIG. 2, the cooling path of air compressor 100 is divided into a cooler cooling path in the upper section and a motor cooling path in the lower section. The air intakes in the cooler and motor cooling paths draw in external air for cooling from two different cooler intake 51 and motor intake 52 for the motor, respectively, but the two paths (cooler cooling path and motor cooling path) merge at an opening 54 at the top of cooler duct 41, and cooling air is exhausted from one common cooling air exhaust port 53 by fan 13.

Therefore, when the airflow through the various coolers decreases due to clogging of the various coolers, the airflow for motor cooling increases. In other words, a phenomenon occurs in which the flow rate in the cooler cooling path decreases and the flow in rate the motor cooling path increases. In the motor cooling path, the cooling air for the motor cools the load side bearing 62 and the anti-load side bearing 61, but the load side bearing 62 tends to be hotter because the anti-load side bearing 61 is easier to cool due to its structure. Therefore, when the amount of cooling airflow is increased, the temperature difference between each bearing becomes smaller because the load side bearing 62 has the same cooling effect as the anti-load side bearing 61. These characteristics are used to determine whether the cooler is clogged.

Figure 3:
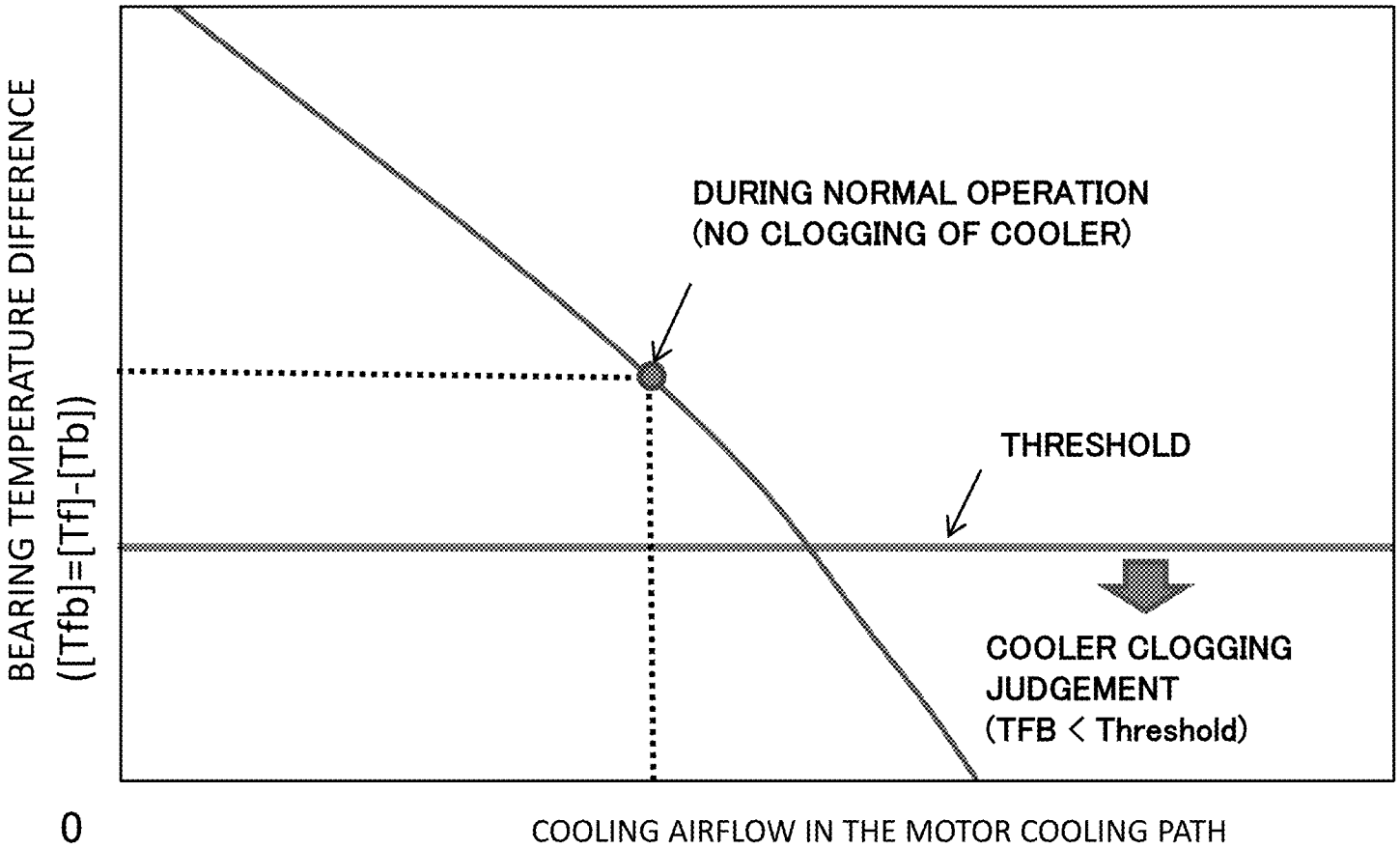
FIG. 3 shows a relationship between cooling air volume and motor bearing temperature difference.

FIG. 3 shows the relationship between the motor cooling airflow and the bearing temperature difference. The bearing temperature difference Tfb is calculated by controller 30 by subtracting the temperature Tb detected by the anti-load side bearing temperature sensor 21 from the temperature Tf detected by the load side bearing temperature sensor 20. During normal operation when there is no clogging of the various coolers, the bearing temperature difference Tfb is large. However, when the various coolers are clogged and the cooling airflow of the motor increases, the bearing temperature difference Tfb becomes small. That is, if the coolers become clogged and the bearing temperature difference Tfb becomes less than the threshold value, controller 30 judges that the coolers are clogged, and makes the display unit 31 display a message to recommend cooler cleaning, such as "Cooler cleaning" by controller 30. Clogged cooler as determined by the control unit 30 means that one, two, or all of cooler for low-pressure stage exhaust air 10, cooler for high-pressure stage exhaust air 11, and cooler for oil 12 are clogged.

One advantage of using the bearing temperature difference to determine cooler clogging is that the bearing temperature varies with the motor speed and current, load conditions of the compressor body, and external air temperature, but these effects can be excluded by using the temperature difference between the anti-load side bearing 61 and load side bearing 62. This temperature difference can also be determined using a temperature sensor used for another heat-generating part (e.g., coil), not limited to the bearing.

This cooler clogging determination is applied only when the air compressor 100 is in load operation. The reason is that during unload operation, the load on the compressor bodies 2 and 3 is low, so the bearing temperatures of the anti-load side bearing 61 and load side bearing 62 are low, and the temperature difference between them is small. However, during unloading, the temperatures of the compressed air and oil cooled in the cooler cooling path are lower, and if the cooler is clogged, no particular problem will occur without cleaning, so clogging judgment is considered unnecessary. Here, load operation refers to a state in which the cooler is operating with a load and exhausting compressed air. On the other hand, unload operation refers to a state in which the compressor is operating at a low load while exhausting a small amount of intake air in order not to stop the compressor.

Figure 4:
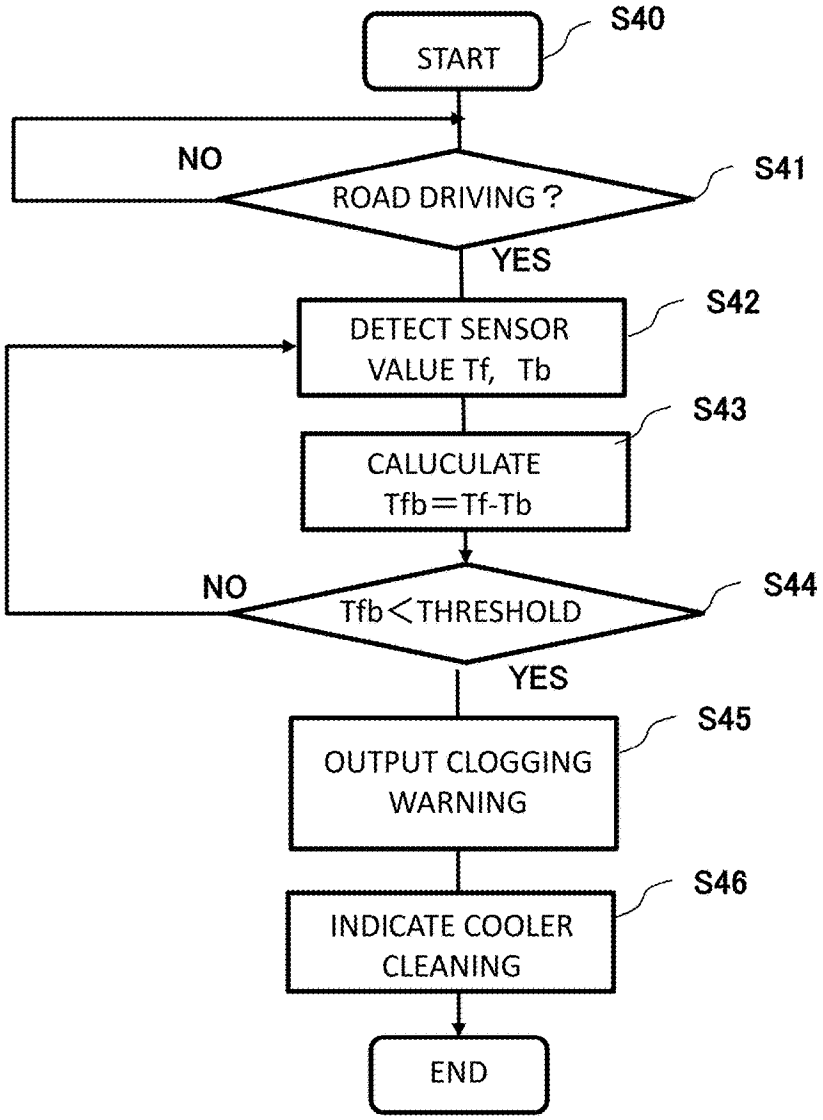
FIG. 4 shows a flowchart of the controller.

FIG. 4 shows the flow chart of the controller. When control of controller 30 is initiated at step S40, first, at step S41, controller 30 determines whether air compressor 100 is in load or unload operation, and if it is in load operation, it moves to step S42.

In step S42, the temperature Tf detected by the load side bearing temperature sensor 20 and the temperature Tb detected by the anti-load side bearing temperature sensor 21 are detected, respectively. The order of steps S41 and S42 can be interchanged, and the detection of temperatures by the load side bearing temperature sensor 20 and the anti-load side bearing temperature sensor 21 can be performed in operating conditions other than load operation.

In step 43, controller 30 calculates the bearing temperature difference Tfb=Tf−Tb based on the temperature detected in step S42.

In step S44, controller 30 determines whether the bearing temperature difference Tfb is smaller than the predetermined threshold. If the bearing temperature difference Tfb is less than the predetermined threshold, go to step S45; otherwise, return to step S42 and perform temperature detection. In this step, the predetermined threshold value may be determined to be less than or equal to the predetermined threshold value. In any case, the predetermined threshold value is stored in advance in the memory of controller 30 (not shown).

In step S45, controller 30 outputs a warning signal for cooler clogging to display unit 31.

In step S46, display unit 31 displays "Cooler cleaning" based on the warning signal output from controller 30 to recommend cooler cleaning. This display may use other forms as long as the content is capable of recommending cooler cleaning to the user.

As described above, according to this embodiment, by using the existing sensors in the air compressor 100, the temperature sensor 21 for the anti-load side bearing and the temperature sensor 20 for the load side bearing, to estimate cooler clogging, it is possible to recommend cooler cleaning at the appropriate timing while controlling cost increase.

Although this example describes an air-cooled oil-free screw compressor, the determination of cooler clogging in the present invention can be applied to oil-cooled air compressors and single-stage or multi-stage air compressors as well.

REFERENCE SIGNS LIST

1: Intake filter
2: Low-pressure stage compressor body
3: High-pressure stage compressor body
4: Motor
5: Gear casing
6: Incremental Gear
7: Pumps for oil
10: Cooler for low-pressure stage exhaust air
11: Cooler for high-pressure stage exhaust air
12: Cooler for oil
13: Cooling fan
15: Lubrication path
16: Cooling path
17: Pool
20: Temperature sensor for motor load side bearing
21: Temperature sensor for motor anti-load side bearing,
30: Controller
31: Display unit
40: Motor cooling air intake duct
41: Cooler Duct,
42: Intake duct for compressed air
50: Compressed air intake
51: Cooler cooling air intake for cooler cooling air (Cooler intake)
52: Motor cooling air intake for motor (Motor intake
53: Cooling Air Exhaust
54: Opening
60: Enclosure,
100: Air compressor

The invention claimed is:

1. An air compressor, comprising:

a compressor body;

a motor for driving the compressor body;

a cooler that cools air compressed by the compressor body;

an enclosure housing the compressor body, the motor, and the cooler;

a cooler duct for separating a cooler cooling path that takes in external air through a cooler intake port provided in the enclosure and a motor cooling path for the motor which cools the motor by drawing an external air through an air intake for the motor provided in the enclosure;

an exhaust port provided in the enclosure to exhaust air merged by an opening from the cooler cooling path and the motor cooling path;

a first sensor for detecting a temperature of a load side bearing of the motor and a second sensor for detecting a temperature of an anti-load side bearing; and a controller for calculating a temperature difference between the first sensor and the second sensor and determining that the cooler is clogged if the temperature difference is less than a threshold value.

2. The air compressor according to claim 1, wherein the air compressor further comprising:

a display unit, and wherein the controller outputs a warning signal to the display unit when the controller determines that the cooler is clogged.

3. The air compressor according to claim 2, wherein the controller determines whether the air compressor is in a load operation, calculates the temperature difference between the first sensor and the second sensor during the load operation, and determines that the cooler is clogged if the temperature difference is less than a threshold value.

4. The air compressor according to claim 3, wherein the compressor body is a multi-stage configuration with a low-pressure stage compressor body and a high-pressure stage compressor body.

5. The air compressor according to claim 3, wherein the cooler has an air cooler for cooling an air compressed by the compressor body, and an oil cooler for cooling the motor and the compressor body.

6. The air compressor according to claim 5, wherein the compressor body has a multi-stage configuration with a low-pressure stage compressor body and a high-pressure stage compressor body.

7. An air compressor, comprising:

a compressor body;

a motor for driving the compressor body;

an air cooler that cools air compressed by the compressor body;

an oil cooler for cooling the motor and the compressor body;

an enclosure housing the compressor body, the motor, the air cooler and the oil cooler;

wherein the enclosure includes:

a cooler intake for intaking an external air for cooling the air cooler and the oil cooler, and a motor cooler intake for intaking an external air for cooling the motor;

wherein the air compressor further comprises, a cooler duct for separating, a cooler cooling path which cools the air cooler and the oil cooler by air drawn from the cooler air intake, and a motor cooling path which cools the motor by air drawn from the motor cooler intake, wherein the cooler duct has an opening merging the cooler cooling path and the motor cooling path, wherein the air compressor further comprises:

a cooling air exhaust port for exhausting the merged air at the opening from the cooler cooling path and the motor cooling path;

a first sensor for detecting a temperature of a load side bearing of the motor, a second sensor for detecting a temperature of an anti-load side bearing of the motor, and a controller for calculating a temperature difference between the first sensor and the second sensor, and determining that the air cooler or the motor cooler is clogged if the temperature difference is less than a threshold value.

* * * * *